United States Patent [19]

Burt

[11] Patent Number: 4,722,562

[45] Date of Patent: Feb. 2, 1988

[54] TAMPERPROOF SHACKLE SEALS

[75] Inventor: David A. Burt, Berkshire, England

[73] Assignee: ITW Limited, Fastex Division, Basingstoke, England

[21] Appl. No.: 938,534

[22] Filed: Dec. 5, 1986

[30] Foreign Application Priority Data

Dec. 9, 1985 [GB] United Kingdom ..... 8530332

[51] Int. Cl.[4] ..... B65D 33/34

[52] U.S. Cl. ..... 292/318

[58] Field of Search ..... 292/316, 318, 319, 320, 292/321, 322

[56] References Cited

U.S. PATENT DOCUMENTS

| | | | |
|---|---|---|---|
| 4,306,745 | 12/1981 | Wenk | 292/318 |
| 4,319,776 | 3/1982 | Moberg | 292/322 |
| 4,588,218 | 5/1986 | Guiler et al. | 292/318 X |
| 4,609,218 | 9/1986 | Chevillard et al. | 292/320 |

FOREIGN PATENT DOCUMENTS

| | | | |
|---|---|---|---|
| 2164003 | 3/1986 | United Kingdom | 292/318 |

*Primary Examiner*—Richard E. Moore

*Attorney, Agent, or Firm*—J. P. O'Brien; T. W. Buckman

[57] ABSTRACT

A tamperproof shackle seal comprising: a strap, a plug at one end of the strap, a housing at the other end of the strap, and a socket embedded within the housing; the strap, the plug and the housing having been integrally formed of a plastics material, and the socket having been separately formed of a plastics material; the plug including a leading end and a shoulder which faces away from said leading end; the housing having a sleeve-like wall which is integrally closed around the socket apart from at an open mouth; and the socket defining a cavity which is closed, apart from at an open entrance in alignment with said open mouth, with at least one resiliently deflectable portion of the socket protruding into said cavity; whereby, in use, said at least one resiliently deflectable portion flexes to permit insertion of the plug into the socket, and then abuts said shoulder to hold the plug captive in the socket.

2 Claims, 5 Drawing Figures

TAMPERPROOF SHACKLE SEALS

The present invention relates to tamperproof shackle seals by which is meant seals of the shackle kind which should be unopenable except by being visibly damaged.

A tamperproof shackle seal usually comprises: a strap, a plug at one end of the strap, and a housing at the other end of the strap; the strap, the plug and the housing having been integrally formed of a plastics material; the plug including a leading end and a shoulder which faces away from said leading end; and the housing having an open mouth leading to at least one resiliently deflectable portion; whereby, in use, said at least one resiliently deflectable portion flexes to permit insertion of the plug into the housing, and then abuts said shoulder to hold the plug captive in the housing.

Typical examples of such tamperproof shackle seals are those disclosed in our British Pat. Nos. 1 430 093 and 1 515 298 to which an interested reader should refer.

A manufacturing problem has been to enable those tamperproof shackle seams to be removable from moulds in which they have been formed. It has been necessary for the housing to be moulded with two open ends to allow the removal of those parts of the mould forming the at least one resiliently deflectable portion. One of the open ends has subsequently been closed by a cap or lid which is held in place by for example heat sealing or ultrasonic welding. However carefully the cap or lid is secured to the housing, there is necessarily some indication that the cap or lid has been secured to the housing. This has lead to the practical problem that a skillful person can remove the cap or lid, by using for example a hot wire, and can then re-secure the cap or lid so that the tampering is not apparent without very close inspection. It would be advantageous if a tamperproof shackle seal could be made whose housing was integrally closed apart from at one opening.

According to the present invention, a tamperproof shackle seal comprises: a strap, a plug at one end of the strap, a housing at the other end of the strap, and a socket embedded within the housing; the strap, the plug and the housing having been integrally formed of a plastics material, and the socket having been separately formed of a plastics material; the plug including a leading end and a shoulder which faces away from said leading end; the housing having a sleeve-like wall which is integrally closed around the socket apart from at an open mouth; and the socket defining a cavity which is closed, apart from at an open entrance in alignment with said open mouth, with at least one resiliently deflectable portion of the socket protruding into said cavity; whereby, in use, said at least one resiliently deflectable portion flexes to permit insertion of the plug into the socket, and then abuts said shoulder to hold the plug captive in the socket.

It will be appreciated that, by forming the socket separately from the strap, the plug and the housing, the socket can be formed of a relatively hard plastics material, such as nylon 6.6, whereas the strap, the plug and the housing can be formed of a softer plastics material, such as polypropylene, in a configuration which would be clearly marked, defaced or damaged in an immediately visibly apparent manner, if subjected to tampering.

Preferably, the socket is integrally formed as two socket portions joined together by a manipulatable portion in the form of a strap of sufficient length to allow rims of the socket portions to fit one within the other.

Nevertheless, the socket could take any one of a number of different forms. It could be formed in more than one piece rather than being integrally formed. It could be formed with a manipulatable portion in the form of a hinge rather than a strap. It could be formed with a single tubular socket portion and a flap or lid rather than two cup-like socket portions. It could be formed with flat rims which merely abut rather than rims which fit one within the other. It could be secured in its cavity-defining condition, for example by adhesive or ultrasonic welding, rather than being merely manipulated into its cavity-defining condition. It could be formed of the same plastics material as the strap, the plug and the housing rather than a different plastics material. A practical constraint is that, during the manufacturing step of embedding the socket within the housing, the plastics material of the housing should not enter the cavity defined by the socket to an extent impeding the ability of the socket to lock the plug therein during subsequent use.

The socket, when in its cavity-defining condition, may be held centrally within a mould for the strap, the plug and the housing by being placed on a retaining pin extending into the mould.

A tamperproof shackle seal, in accordance with the present invention, will now be described, by way of example only, with reference to the accompanying drawings, in which.

Figure 1:
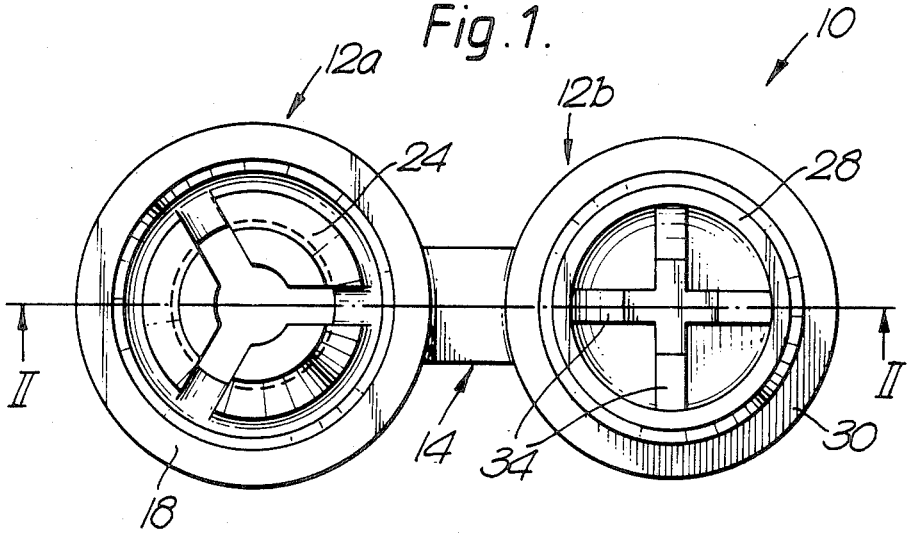
FIG. 1 is a plan view of the socket in its as-moulded condition before forming part of the tamperproof shackle seal.
Figure 2:
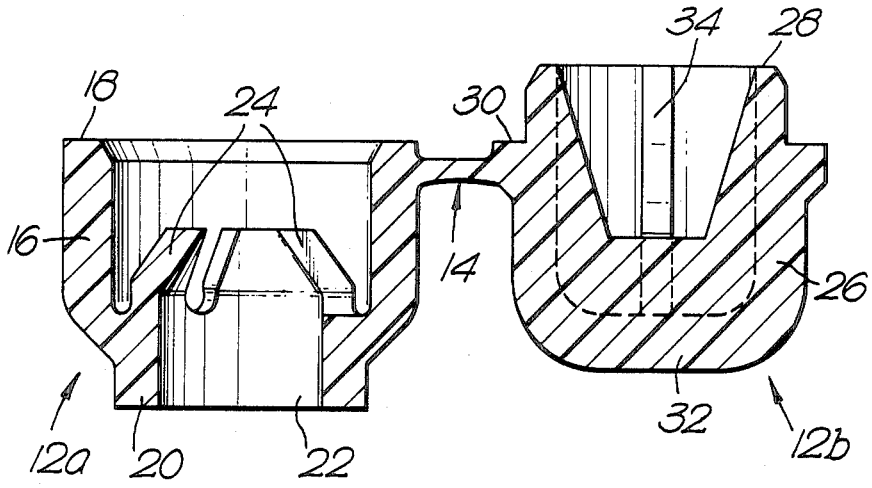
FIG. 2 is a cross-section taken on the line II—II of FIG. 1.

Referring initially to FIGS. 1 and 2, a socket 10 is illustrated in its as-moulded condition. The socket 10 is integrally formed of a nylon resin material as two cup-like socket portions 12*a*, 12*b* joined together by a manipulatable portion in the form of a strap 14. The socket portion 12*a* includes a peripheral wall 16 having an annular rim 18 at one end and an annular wall 20 at its other end. The wall 20 defines an open cylindrical entrance 22 leading to three resiliently deflectable fingers 24 which converge with increasing distance from the entrance 22. The socket portion 12*b* includes a peripheral wall 26 having an annular rim 28 at one end, an annular shoulder 30 formed near its junction with the strap 14, and a closed wall 32 at its other end. Four bracing webs 34 extend inwardly from the peripheral wall 26 and converge to form a cruciform arrangement on the closed wall 32.

It should be appreciated that the socket 10 need not necessarily be formed as illustrated, for example the three resiliently deflectable fingers 24 could be replaced by a single resiliently deflectable constriction in the socket portion 12*a*, and the four bracing webs 34 could be omitted from the socket portion 12*b*.

By manipulating the strap 14, the socket portions 12*a*, 12*b* can be brought into a condition in which the socket 10 defines a cavity which is closed, apart from at the open entrance 22. This condition is shown in side elevation in FIG. 3 and in cross-section in FIG. 5. To assist in the manipulation, the inner edge of the rim 18 and/or the outer edge of the rim 28 can be chamfered, the rim 28 being a tight press fit within the rim 18 to ensure that the cavity-defining condition of the socket 10 is maintained. It is particularly clear from FIG. 5 that, when the rim 28 fits fully within the rim 18, the shoulder 30 rests upon the rim 18.

The socket 10, in its cavity-defining condition, is held centrally within a two-part mould for the remainder of the tamperproof shackle seal by being placed on a retaining pin 36. The retaining pin 36 includes a cylindrical portion 38 complementary to the entrance 22 defined by the wall 20 of the socket portion 12*a*, and further includes a bulbous portion 40 which is just sufficiently large to make releasable steadying engagement with the free ends of the resiliently deflectable fingers 24. After moulding of the remainder of the tamperproof shackle seal around the socket 10, the retaining pin 36 is withdrawn as a consequence of being secured to one of the parts of the two-part mould.

Figure 3:
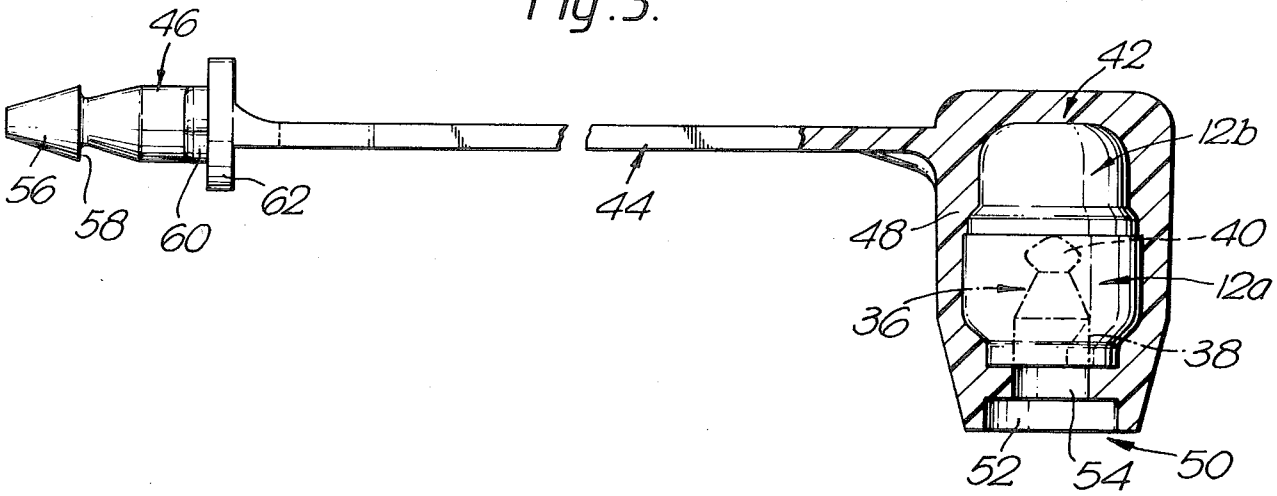
FIG. 3 is a side view of the tamperproof shackle seal, the strap being shown as broken along its length, the housing and an adjacent part of the strap being shown in cross-section, the socket being shown in side elevation in its cavity-defining condition and a retaining pin being shown in dotted outline.
Figure 4:
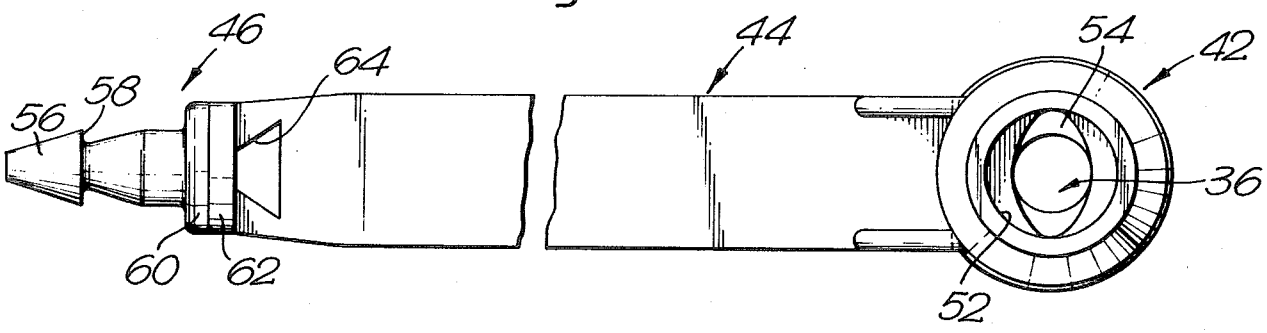
FIG. 4 is an underneath view of FIG. 3.

As is clear from FIGS. 3 and 4, the socket 10 is caused to become embedded in a housing 42. The housing 42 is formed of polypropylene integrally with a strap 44 and a plug 46. The plug 46 is formed at one end of the strap 44 and the housing 42 is formed at the other end of the strap 44. The housing 42 has a sleeve-like wall 48 which is integally closed around, and indeed shrinks tightly onto, the socket 10 apart from at an open mouth 50 in alignment with the open entrance 22. More particularly, the open mouth 50 includes a portion 52 of circular profile and a portion 54 of oval profile. The plug 46 includes a leading end 56 and a shoulder 58 which faces away from the leading end 56. The plug 46 also includes a portion 60 of oval profile complementary to the portion 54 of the open mouth 50, and a portion 62 of circular profile complementary to the portion 52 of the open mouth 50. The plug 46 is joined to said one end of the strap 44 by a weakened cross-section resulting from the presence of an aperture 64 through said one end of the strap 44.

Figure 5:
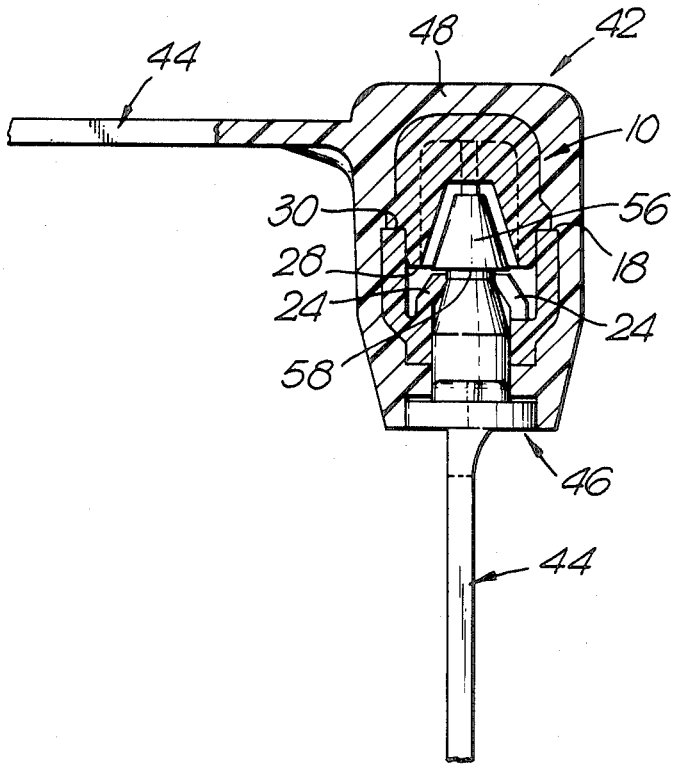
FIG. 5 is a fragmentary partial cross-section showing the tamperproof shackle seal in use.

The locked condition of the tamperproof shackle seal is shown in FIG. 5. Insertion of the plug 46 into the socket 10 has caused the resiliently deflectable fingers 24 to flex and then abut the shoulder 58 to hold the plug 46 captive in the socket 10. The plug 46 thus cannot be subsequently released from the socket 10 without necessarily causing visible damage.

A tamperproof shackle seal has thus been disclosed which is advantageous, in comparison with known tamperproof shackle seals, by providing a housing which is integrally closed apart from at an open mouth for receiving a plug, the housing thus being unopenable except by causing visible damage.

I claim:

1. A tamperproof shackle seal comprising;

a strap, a plug at one end of said strap and a housing at the other end of said strap, said plug and said housing having been molded together from a first plastic material, a socket completely embedded within said housing, said socket having been separately molded of a second plastic material of harder material than said first plastic material, said plug having a leading end and a shoulder which faces away from said leading end, said housing having a sleeve-like wall of uninterrupted seamless construction which integrally closes around said socket apart from at an open mouth which is smaller in width than the width of said socket, said socket having a cavity which is closed apart from at an open entrance which is in direct alignment with said open mouth, and at least one resiliently deflectable portion integrally formed in said socket in a protruding manner into said cavity, whereby in use, said at least one resiliently deflectable portion flexes to permit insertion of said plug into said socket and thereafter abuts said shoulder to hold said plug captive in said socket.

2. A tamperproof shackle seal as defined in claim 1, wherein said socket comprises two socket sections which are snap fitted together, said socket sections being interconnected by a strap portion adjacent their mating ends, said strap being of sufficient length to permit said socket sections to be manipulated into their mating relationship.

* * * * *